United States Patent [19]

Kenny et al.

[11] Patent Number: 4,458,116

[45] Date of Patent: Jul. 3, 1984

[54] THROTTLE OPERATED CONTROLLER ASSEMBLY

[75] Inventors: Andrew A. Kenny, Roselle; Kirk B. Peloza, Glen Ellyn, both of Ill.

[73] Assignee: Eaton Corporation, Cleveland, Ohio

[21] Appl. No.: 244,944

[22] Filed: Mar. 18, 1981

[51] Int. Cl.[3] ..... H01H 3/42

[52] U.S. Cl. ..... 200/61.89; 200/61.91; 200/153 LB; 200/153 L

[58] Field of Search ..... 200/61.89, 61.90, 61.91, 200/31 A, 153 L, 153 LB, 293

[56] References Cited

U.S. PATENT DOCUMENTS

| | | | |
|---|---|---|---|
| 2,210,793 | 8/1940 | Butler | 200/153 L |
| 2,769,099 | 10/1956 | Peterlik et al. | 200/153 LB |
| 2,836,669 | 5/1958 | Rosenberg | 200/153 LB |
| 2,876,313 | 3/1959 | Dull et al. | 200/153 L |
| 3,270,582 | 9/1966 | Barth | 200/153 LB |

FOREIGN PATENT DOCUMENTS

| | | | |
|---|---|---|---|
| 624248 | 5/1949 | United Kingdom | 200/31 A |
| 2040581 | 8/1980 | United Kingdom | 200/153 L |

*Primary Examiner*—John W. Shepperd

*Attorney, Agent, or Firm*—C. H. Grace; R. A. Johnston

[57] ABSTRACT

A switch assembly adapted for actuation by connection to an engine throttle shaft. The switch housing is adapted for mounting on an engine and has a rotary cam received therein having a socket for connection to the engine throttle shaft. Rotation of the cam sequentially actuates a plurality of electrical switches. The housing has a stationary and movable member with some of the switches mounted on each. A helical screw engages teeth on the movable member and for adjusting the relative position between the housing members. The screw is readily accessible from the exterior of the housing and rotation of the screw adjusts the at-rest position of the cam with respect to the switches for enabling easy calibration after installation on the engine.

6 Claims, 6 Drawing Figures

| ACTUATION LOGIC | | |
|---|---|---|
| ANGLE | EPR REF. | EGR REF. |
| 0° | 1 | 0 |
| 10° | 1 | 0 |
| 11° | 1 | 0 |
| 12° | 1 | 0 |
| 13° | 1 | 0 |
| 14° | ACTUATION RANGE | 0 |
| 15° | | 0 |
| 16° | | 0 |
| 17° | | 0 |
| 18° | | 0 |
| 19° | 0 | ACTUATION RANGE |
| 20° | 0 | |
| 21° | 0 | |
| 22° | 0 | |
| 23° | 0 | |
| 24° | 0 | 1 |
| 25° | 0 | 1 |
| 30° | 0 | 1 |
| 40° | 0 | 1 |
| 50° | 0 | 1 |
| 60° | 0 | 1 |
| 70° | 0 | 1 |
| 80° | 0 | 1 |
| 90° | 0 | 1 |
| 100° | 0 | 1 |

THROTTLE OPERATED CONTROLLER ASSEMBLY

BACKGROUND OF THE INVENTION

The present invention relates to controllers for providing actuation of a plurality of separate electrical switches for making and breaking circuits to separate control devices. Switch controllers of this type are employed for controlling the operation of certain emission control devices in response to throttle shaft movement on automotive internal combustion engines. It has been found convenient in the design of emission control systems for diesel engines to provide a coupling to the engine throttle shaft and to actuate certain emission control devices, such as, for example, exhaust gas recirculation (EGR) exhaust pressure relief (EPR) and Torque Converter Clutch (TCC) devices upon a predetermined movement of the engine throttle shaft.

Devices which are received over the end of the engine throttle shaft and which employ a rotating cam means to actuate a single electrical switch mechanism are known, as for example, the device described in a copending application Ser. No. 146,903 filed May 5, 1980, Fluid Pressure Liquid Signal Controller, and assigned to the assignee of the present invention.

However, in providing diesel engine emission control systems a need has arisen to provide for actuation of a plurality of separate electrical switch mechanisms in response to different predetermined amounts of rotation of an engine throttle shaft. In providing such emission control systems it has been found extremely difficult to provide a means of conveniently mounting the switch mechanisms in a manner which readily provides for separate calibration of the switch mechanisms with respect to the predetermined amount of rotation of the throttle shaft.

Furthermore, it has been desirable to provide for actuation of a plurality of electrical switch mechanisms in response to different amounts of rotation of an engine throttle shaft and to provide for accurate and convenient calibration of some of the switch mechanisms after the device has been installed on the vehicle engine. Thus, a need has arisen for a device which provides for separate actuation of a plurality of electrical switch mechanisms responsive to different degrees of rotation of an input shaft, as for example, a vehicle engine throttle shaft and provides for convenient and readily accessible field calibration of the device after installation. In addition, it has been desired to provide such a device with a readily accessible field calibration feature, yet provide calibration which would not change or shift during prolonged engine service.

SUMMARY OF THE PRESENT INVENTION

The present invention provides a device adapted for attachment to a rotatable shaft, as for example, the throttle shaft of an automotive internal combustion engine and which provides actuation of a plurality of separate electrical switch mechanisms in response to predetermined different rotational inputs from the engine throttle shaft. The device of the present invention is particularly applicable for actuation of electrical switches which operate various engine emission control mechanisms such as EGR devices.

The present invention employs a rotary cam means which has cam surfaces on the face and periphery thereof for separately actuating individual electrical switches.

The present invention employs a rotary cam received in a housing formed of a stationary member and a movable member rotationally retained thereon wherein some of the electrical switches are mounted on the stationary member and some are mounted on the movable portion of the housing. Relative rotation between the housing portions provides for calibration of at least some of the electrical switches with respect to the rotatable cam. The peripheral cam surface is contacted by a floating ring cam follower. A helical adjustment screw retained on the stationary portion of the housing engages gear teeth on the movable portion such that rotation of the screw provides for rotational adjustment of the movable housing portion with respect to the stationary portion. The adjustment screw is readily accessible from the exterior of the housing and permits calibration of the assembly after installation on an engine.

The present invention thus provides a novel electrical switch controller for actuating a plurality of separate electrical switches in response to different degrees of rotation of an engine throttle shaft. The invention employs a floating ring cam follower on the peripheral cam and provides a device which permits ease of calibration of the switch actuation points after installation of the device on the engine throttle shaft.

DETAILED DESCRIPTION

Figure 1:
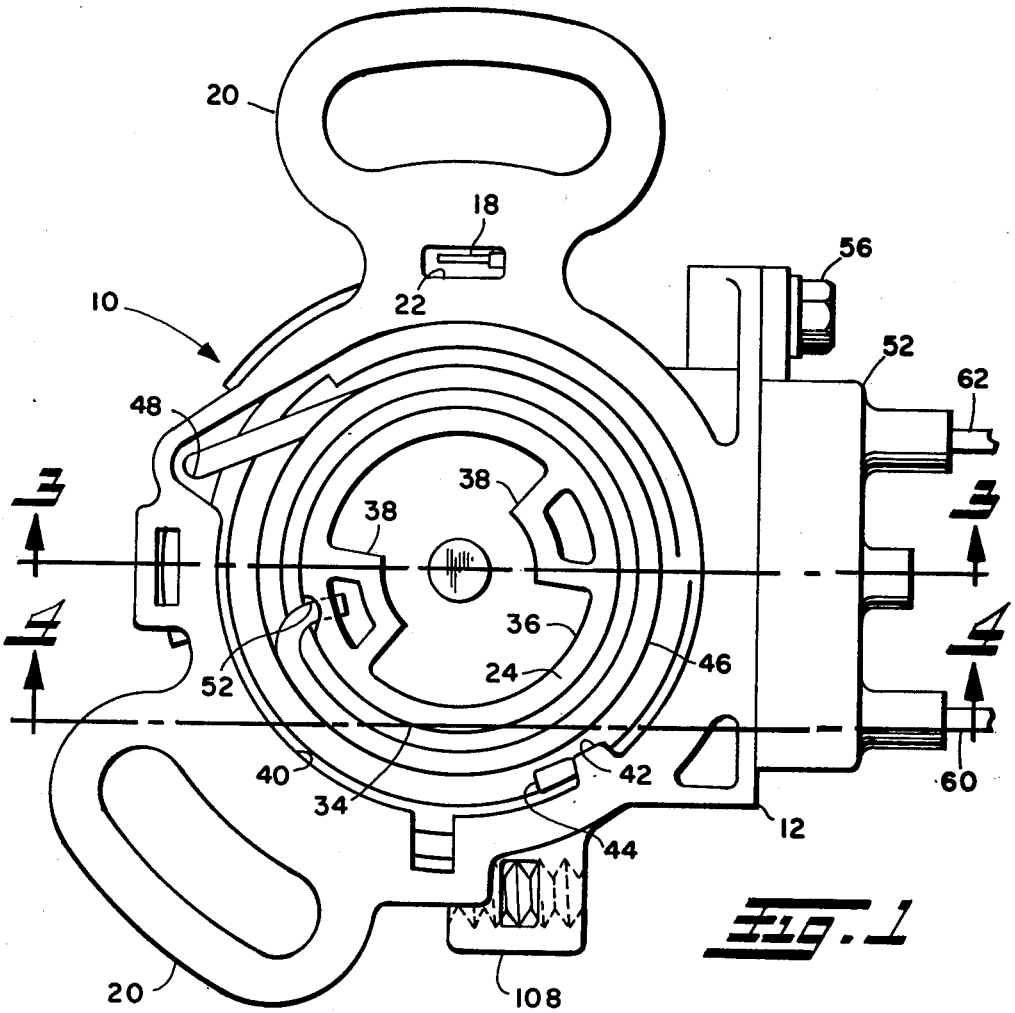
FIG. 1 is a top view of the switch actuator assembly of the present invention.

Referring now to FIGS. 1 through 4, the switch actuator assembly is indicated generally at 10 as having a housing means comprising a stationary member 12 and a movable member 14 rotatably received thereon and retained about the periphery by a plurality of circumferentially spaced lugs shown typically at 16. A spring biased retaining clip 18 received in a retaining slot 22 provided about the periphery of the stationary housing member 12 secures the movable member 14 in place. The stationary housing member 12 has a pair of slotted attachment lugs 20 extending outwardly therefrom for providing a means for attaching the assembly to a suitable mounting location adjacent the throttle shaft on the vehicle engine. In the presently preferred practice, the members 10, 14 are formed of any plastic material suitable for engine compartment environment service.

Figure 3:
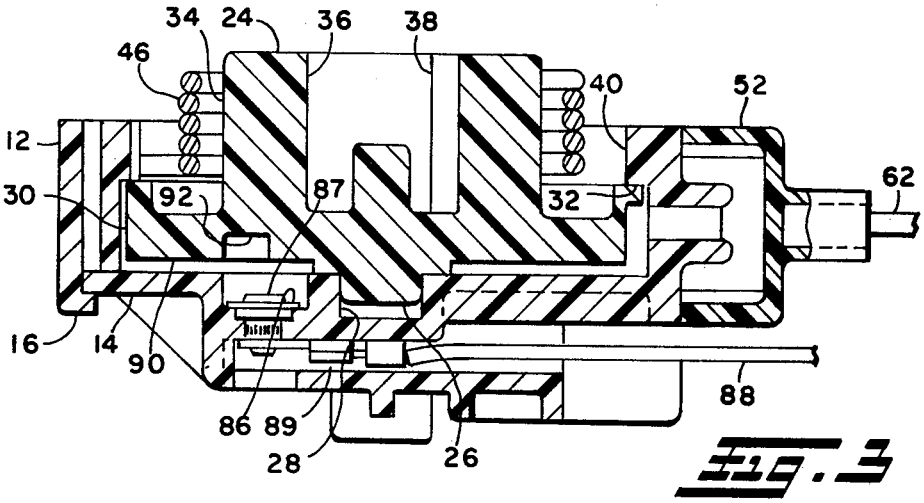
FIG. 3 is a section view taken along section indicating lines 3—3 of FIG. 1.
Figure 4:
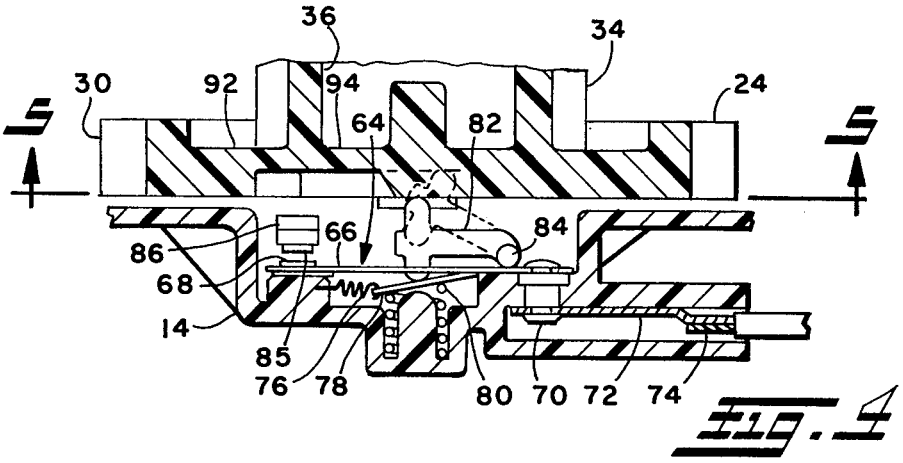
FIG. 4 is a section view similar to FIG. 3 taken along section indicating lines 4—4 of FIG. 1.

With particular reference to FIGS. 3 and 4, a rotary cam means in the form of member 24 is rotatably received in the stationary housing portion 12 and retained therein by the movable housing portion 14. The rotary cam 24 has a pilot 26 formed on the lower surface thereof which is received in a pilot bore 28 provided in the movable housing member 14. Cam 24 has a larger diameter portion 30 which has the upper face thereof in sliding registration with an annular shoulder 32 provided in the stationary housing portion.

The rotary cam 24 has a reduced diameter portion 34 which extends upwardly from the larger diameter portion 30 as shown in FIGS. 3 and 4. The reduced diameter portion 34 has a drive socket 36 provided centrally in the upper surface thereof, the socket 36 having a plurality of circumferentially spaced torque transmitting lugs 38 provided therein. The socket 36 is adapted to be received over the end of an engine throttle shaft and the lugs 38 are adapted to engage corresponding engagement surfaces provided on the throttle shaft for transmitting rotary motion to the cam member 24. In the presently preferred practice, cam 24 is also formed of plastic material suitable for engine room.

Annular shoulder 32 intersects a bore 40 which forms the inner periphery of the stationary member 12 and bore 40 has a rotary stop lug 42 provided thereon (see FIG. 1) which has registered thereagainst, a corresponding stop lug 44 provided on the outer periphery of the larger diameter portion 30 of the rotary cam.

A bias or return spring 46 is received over the reduced diameter portion 34 of the rotary cam with one end of the spring anchored in an aperture 48 provided in the stationary portion 12 of the housing (see FIG. 1). The other end of the spring 46 is anchored in a hole 52 provided in the reduced diameter portion 34 of the rotary cam and adjacent the upper surface thereof. The spring 46 as shown in FIG. 1 resists clockwise rotation of the cam 24 and biases the cam 24 in a counterclockwise direction to cause cam stop 44 to register against stop lug 42.

Referring now to FIGS. 1 through 4, the embodiment of the invention illustrated utilizes three separately actuated electrical switch mechanisms, one of which is enclosed by a cap 52 attached to the right-hand end of the stationary housing member 12 and retained thereon by retaining lug 54 (see FIG. 2) and screw 56. Cap 52 is thus removable from the housing member 12 for assembly of the switch mechanism indicated generally at 58 which will be described hereinafter in greater detail.

Cap 52 has provision for a pair of electrical leads 60, 62 extending therefrom for circuit attachment to the switch mechanism 58.

Figure 2:
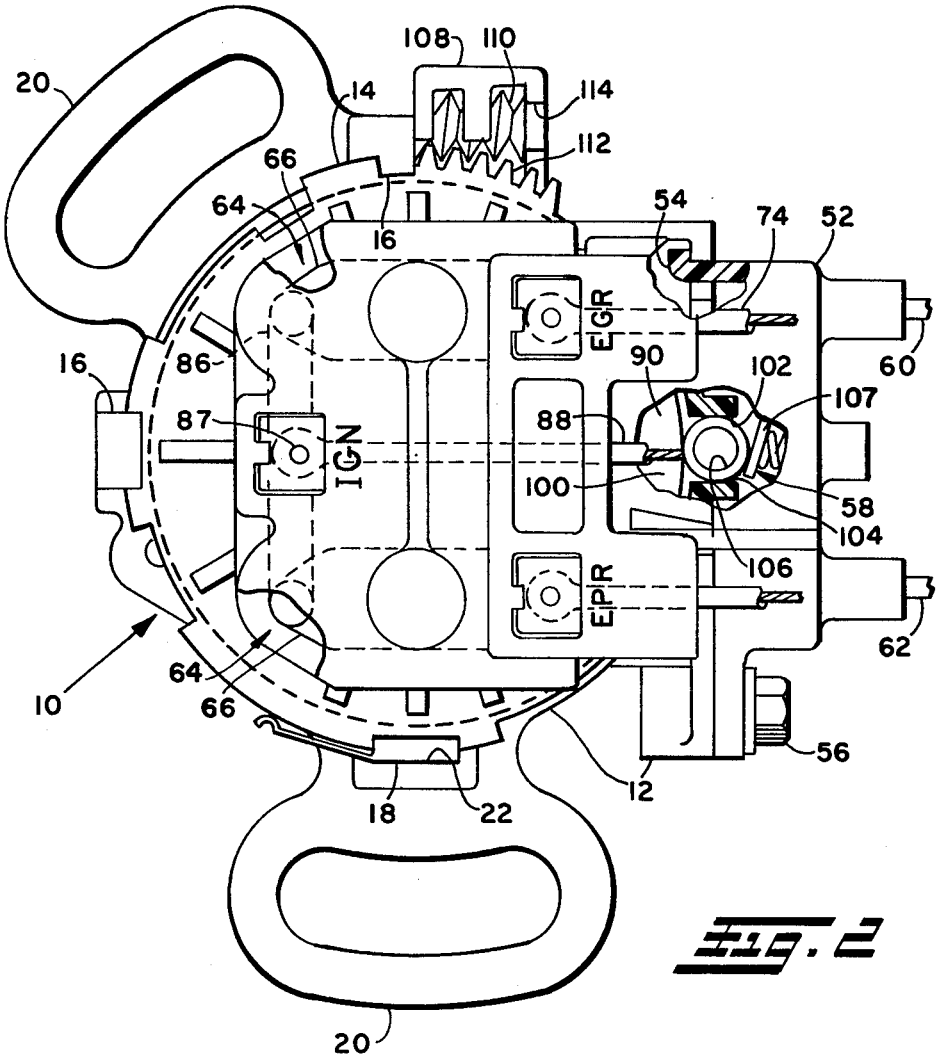
FIG. 2 is a bottom view of the assembly of FIG. 1 with portions thereof broken away to show the cam follower for one of the electrical switches.

The device 10 of the present invention employs, in addition to the switch mechanism 58, a second and third switch mechanism located in spaced parallel arrangement within the housing, with the blades and contacts thereof oriented as shown in dashed outline in FIG. 2. With reference to FIG. 4, the details of the second switch mechanism indicated generally at 64 is illustrated and which switch mechanism 64 is located for attachment to the terminal labeled "EGR" in FIG. 2. It will be understood that the illustration of switch mechanism 64 is typical of the third switch mechanism which is located for attachment to the terminal labeled "EPR" in FIG. 2 and as shown in the dashed outline adjacent thereto. For brevity, a detailed description of the third switch has been omitted.

With reference to FIG. 4, switch mechanism 64 is illustrated as having a blade 66 with a movable contact 68 attached thereto at one thereof with the opposite end riveted to the connecting terminal 70 which extends through the wall of the housing member 14 and has a lead strap 72 also riveted thereto which strap connectes to electrical lead 74 (see also FIG. 2). The blade 66 is actuated by an overcenter toggle mechanism comprising spring 76 having one end anchored to the contact end of blade 66 with the other end connected to actuator tang 78 which forms an integral part of blade 66 by techniques well known in the art of snap action switch construction. A switch return or bias spring 80 is received in a groove formed in the wall of housing 14 and urges the actuator tang 78 in an upward direction.

A cam follower 82 is pivotally anchored by pin 84 in an aperture provided in the wall of housing member 14 for rotation thereabout and is operative to actuate the switch mechanism 64 as will be hereinafter described. In the presently preferred practice the cam follower is formed of a suitable plastic material and pin 84 is formed integrally therewith.

A second electrical contact 85 is provided and is attached to a stationary bus bar 86, which extends transversely of section indicating lines 5—5; and, bus bar 86 interconnects contact 84 with a corresponding stationary contact for the third switch mechanism associated with the EPR terminal, which switch mechanism has been omitted for clarity. The bus bar 86 is anchored intermediate its ends to the wall of housing member 14 by rivet 87 (see FIG. 3) and a terminal strap 89 is employed which strap is connected to wire lead 88. The connection is labeled "IGN" in FIG. 2.

Figures 5, 6:
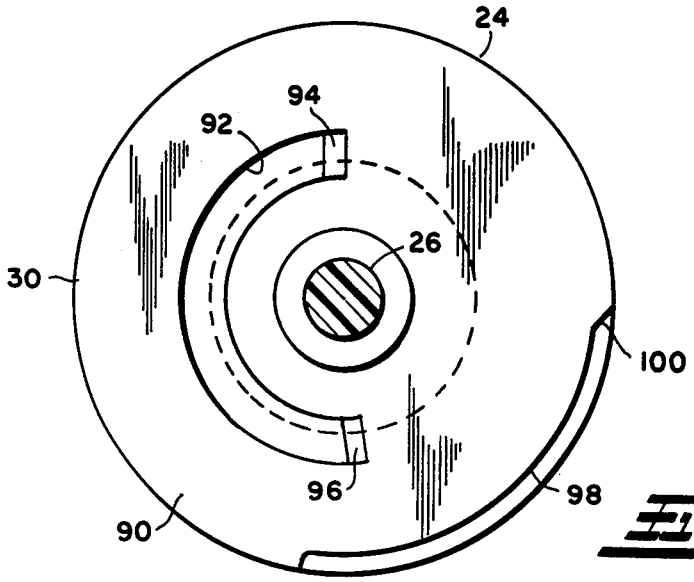
FIG. 5 is a partial section view taken along section indicating lines 5—5 in FIG. 4 and shows the arrangement of the face of the rotary cam.
FIG. 6 is a table giving the switch actuation logic of a typical cam arrangement for the present invention.

Referring now to FIG. 5, the undersurface 90 of the larger diameter 30 of rotary cam 24 is shown as having an arcuate cam face groove 92 extending approximately 190 degrees circumferentially therearound. The groove 92 has inclined cam surfaces 94, 96 at the ends thereof which surfaces, upon rotation of member 24, contact the cam followers for the switch mechanisms associated with the EGR and the EPR electrical leads, one of which followers 82 is typically shown in FIG. 4 for the EGR switching circuit. With continuing reference to FIG. 5, the cam face 90 has formed in its outer periphery a second cam groove 98 which extends in the presently illustrated embodiment circumferentially about the outer periphery somewhat more than one-fourth the periphery thereof. Cam groove 98 has a radially inclined cam surface 100 at the upper end of the groove.

Referring now to FIG. 4, in operation, as cam member 24 is rotated, the cam surfaces 94, 96 engage the switch cam followers provided for each of the switches 64, such as follower 82 shown in FIG. 4, and move the follower 82 from the position shown in dashed outline to the position shown in solid outline thereby actuating switch mechanism 64 to open contacts 68 and 85. Upon reverse movement of the cam 24, cam surface 94 permits actuator 82 to move upwardly to contact the groove 92, to the dashed outline position shown in FIG. 4, thereby deactuating switching mechanism 64. It will be understood that similarly a corresponding cam follower (not shown) contacts surface 96 for actuation of a switch mechanism (not shown) associated with the EPR electrical lead, but which switch is similar to the switch illustrated in FIG. 4.

Referring now to FIG. 2, a pair of guide surfaces 102, 104 are provided in the stationary housing member 12 and have received therebetween a cam follower 106 having preferably a ring-shaped configuration. Cam follower 106 contacts the edge cam groove 98 on one side thereof and on the opposite side thereof contacts a switch actuator tang 107 operative for actuating switch mechanism 58. Switch 58 includes stationary contact 109 and movable contact 111 connected respectively to leads 60, 62.

With cam member 24 in the at-rest position shown in FIG. 2, cam surface 100 has contacted the ring 106 and moved the ring rightward with respect to FIG. 2 for actuation of the switch mechanism 58 and the ring is in contact with the outer diameter 30 of the cam member. Upon counterclockwise rotation of cam member 24 with respect to the view in FIG. 2, the ring moves down cam surface 100 to the groove 98 for deactuating switch mechanism 58.

Referring now to FIGS. 1 and 2, the stationary housing member 12 has a cage portion 108 formed thereon about the periphery of the movable portion 14 of the housing. Cage 108 has received therein a worm or helical screw 110 with the rotational axis thereof oriented generally at right angles to the axis of rotation of movable member 14. The screw 110 engages a plurality of circumferentially spaced teeth 112 provided in the outer periphery of the movable housing member 14 such that upon rotation of the screw 110 housing member 14 is rotated relative to stationary housing member 12. The adjustment screw 112 has the right-hand end thereof accessible through an aperture 114 provided in the cage 108 which permits insertion of a tool therein for rotating screw 112.

It will be understood that the at-rest position of cam member 24 is determined by the location of stop member 42 provided on the stationary housing portion 12 and thus, the switching mechanisms associated with the EGR and EPR terminals, being mounted on the movable housing portion 14, are rotated with respect to the at-rest position of cam 24 by rotation of screw 112. Rotational movement of the switching mechanism mounted on the movable housing portion 14 thus results in a change of the calibration of the actuation points of the switches for a given rotation of the cam 24.

The helical screw arrangement of the present invention thus permits the switches for the EPR and EGR circuit leads to be calibrated for actuation point after the assembly 10 is mounted on the vehicle engine. The present invention thus provides a novel switching assembly for actuation by vehicle throttle shaft which enables a plurality of switching mechanisms to be actuated by predetermined amounts of throttle shaft rotation. The assembly of the present invention permits calibration of the actuation point of the switches to be conveniently performed after the assembly is mounted to the vehicle engine.

With reference to FIG. 6, a typical table of switch actuation logic is shown for the switches actuated by cam surfaces 94, 96 with respect to rotation of the cam 24 from an at-rest position through a specified angular rotation. From FIG. 6 it will be seen that, typically, the switch mechanism associated with the EPR lead, is initially in the closed circuit state with the cam at rest and deactuates within a 5 degree angle of rotation and is thereafter open. The switch mechanism associated with the EGR lead is initially in the open circuit configuration and actuates after the cam has rotated through an angle of approximately 18 degrees with the actuation occurring over a 5 degree range of cam rotation with the switch thereafter being in closed circuit configuration.

Although the invention has been described hereinabove in the presently preferred practice and with regard to the illustrated embodiment, it will be understood that modification and variation of the invention may be made by those having ordinary skill in the art and the invention is limited only by the following claims.

We claim:

1. A switch assembly comprising:

(a) housing means adapted for attachment to a device having a rotating member, said housing means including a stationary member and a movable member received thereon and rotatable with respect thereto for adjustment, said housing means including guide means thereon;

(b) cam means rotatably mounted on said housing means, said cam means including a means defining a first cam surface on the periphery thereof, a second cam surface on the face thereof and including socket means defining surfaces adapted for engagement of a shaft member for receiving rotary inputs therefrom;

(c) first electrical switch means mounted on said housing means and having actuator means operative to actuate and deactuate said switch means for making and breaking a circuit;

(d) a floating cam follower comprising a member guided by said guide means and slidable therein upon contacting said first cam surface for effecting actuation of said first switch means;

(e) second switch means having actuating means responsive to said second cam surface for making and breaking a circuit;

(f) adjustment means attached to said housing means stationary member, said adjustment means including a worm member rotatable about an axis generally at right angles to the axis of rotation of said movable member, said adjustment means being operative, upon rotation of said worm member, to effect adjustment of the relative rotational position of said movable housing member with respect to said stationary member for adjusting the position of said second switch actuation means with respect to said second cam surface for a given position of said cam means;

(g) means operable to apply a bias to said cam means in one direction rotationally; and, (h) stop means operable to limit the rotational movement of said cam means in the direction of said bias.

2. The device defined in claim 1, wherein said movable housing member has a plurality of spaced teeth formed on the periphery thereof, said teeth engaging said worm member for providing said rotational adjustment.

3. The assemby defined in claim 1, wherein said housing movable member is releasably retained about the periphery of said stationary member.

4. The assembly defined in claim 1, wherein said adjustment means includes a helically threaded worm member retained on said stationary housing member engaging a plurality of teeth spaced about said movable housing member.

5. A switch assembly comprising:

(a) housing means adapted for attachment to a device having a rotating member, said housing means including guide means thereon and stationary means and movable means received thereon and rotatable with respect thereto for adjustments;

(b) cam means rotatably mounted on said housing means, said cam means including means defining a first cam surface formed on the periphery thereof and means defining a cam surface on the face thereof and said cam means having an initial at-rest position with respect to one of said stationary or movable means, said cam means including means defining drive surfaces adapted for engagement with a shaft for rotation therewith from said at-rest position;

(c) first electrical switch means mounted on said housing means and means operative upon actuation and deactuation to make and break a circuit;

(d) cam follower means operative to contact said first cam surface and effect actuation and deactuation of said first switch means, said cam follower means comprising a ring received in said guide means;

(e) second switch means responsive to said face cam surface for making and breaking a circuit;

(f) adjustment means mounted on said housing means for rotation about an axis generally at right angles to the axis of rotation of said movable means with respect to said stationary means, said adjustment means operative upon rotation thereof to effect relative movement between said movable means and said stationary means for adjusting the positions of said second switch means with respect to the at-rest position of said face cam surface; and (g) means biasing said cam means to the at-rest initial position.

6. The assembly defined in claim 5, wherein said second electrical switch means comprises a plurality of individually actuable electrical switches mounted on one of said stationary member and said movable member from which said cam means at-rest position is defined.

* * * * *